United States Patent [19]

Okuda

[11] Patent Number: 5,074,274

[45] Date of Patent: Dec. 24, 1991

[54] IGNITION SYSTEM FOR INTERNAL COMBUSTION ENGINES

[75] Inventor: Hiroshi Okuda, Himeji, Japan

[73] Assignee: Mitsubishi Denki Kabushiki Kaisha, Tokyo, Japan

[21] Appl. No.: 658,606

[22] Filed: Feb. 21, 1991

[30] Foreign Application Priority Data

Mar. 29, 1990 [JP] Japan ..... 2-78778

[51] Int. Cl.[5] ..... F02P 3/04; F02P 3/08

[52] U.S. Cl. ..... 123/604; 123/605; 123/598

[58] Field of Search ..... 123/596, 598, 599, 602, 123/604, 605; 315/209 CD, 209 SC

[56] References Cited

U.S. PATENT DOCUMENTS

| | | | |
|---|---|---|---|
| 3,677,255 | 7/1972 | Withem | 123/604 |
| 4,699,115 | 10/1987 | Terada et al. | 123/604 |
| 4,809,661 | 3/1989 | Kinoshita et al. | 123/602 X |
| 4,833,369 | 5/1989 | White | 123/605 X |
| 4,839,772 | 6/1989 | Choi et al. | 123/604 X |
| 4,892,080 | 1/1990 | Morino et al. | 123/605 X |
| 4,967,718 | 11/1990 | Scarnera | 123/604 X |

FOREIGN PATENT DOCUMENTS

| | | | |
|---|---|---|---|
| 0148071 | 10/1989 | Japan . | |
| 2043166 | 10/1980 | United Kingdom | 123/604 |

*Primary Examiner*—Willis R. Wolfe

*Attorney, Agent, or Firm*—Sughrue, Mion, Zinn, Macpeak and Seas

[57] ABSTRACT

An ignition system for internal combustion engines comprising an ignition coil (38), a power circuit (30) including a converter for converting the output of a battery (31) into a high voltage, a capacitor (37) arranged at the primary side of the ignition coil (38) and charged by the output from the power circuit (30), a discharging control thyristor (41) which conducts at a spark-timing of an internal combustion engine to discharge electric charges in the capacit of (37) into the primary winding (38*a*) of the ignition coil (38) and converter control means (49, 52) which makes the converter inactive earlier than the input of a trigger signal to the gate of the thyristor (41) by a first predetermined time ($t_1$), and which makes the converter active again in a second predetermined time ($t_2$) since the thyristor (41) has been triggered to conduct.

8 Claims, 4 Drawing Sheets

IGNITION SYSTEM FOR INTERNAL COMBUSTION ENGINES

BACKGROUND OF THE INVENTION

1. Field of the Invention

The present invention relates to an ignition system for internal combustion engines, and is more particularly concerned with an ignition system for internal combustion engines which ensures ignition.

2. Discussion of Background

Referring to FIG. 3, there is shown a schematic circuit diagram of a conventional ignition system for internal combustion engines, which has been disclosed in e.g. Japanese Unexamined Patent Publication No. 148071/1989. In FIG. 3, reference numeral 1 designates a power circuit. The power circuit is constituted by a battery 2 and a converter. The converter includes a transformer 3 connected to the battery 2, a transistor 4 connected to a transformer 3, a transistor 5 connected to the base of the transistor 4, a diode 7 connected to the base of the transistor 5, and an oscillation circuit 8 connected to the diode 7. The transformer 3 has the secondary winding connected to the primary winding of an ignition coil 11 through a diode 9 and a capacitor 10. The ignition coil 11 has the secondary winding connected to a spark plug 12. The capacitor 10 has one end grounded through a diode 13. The capacitor 10 has the other end grounded through a discharge control thyristor 14. The thyristor 14 has the gate connected to a signal coil 16 through a spark-timing control circuit 15. Reference numeral 17 designates a power supply prevention circuit which includes a comparator 18. The comparator has a noninverted terminal connected to the gate of the thyristor 14. The comparator has an inverted terminal connected to the junction between reference resistors 19 and 20. The comparator has an output terminal connected to the base of the transistor 5 through a diode 22. Reference number 21 designates a resistor which is connected to the output terminal of the comparator 18.

The operation of the conventional ignition system shown in FIG. 3 will be described. The voltage from the battery 2 is increased to a high level by the transformer 3. The high voltage is rectified by the diode 9, and charges a capacitor 10. A signal which is generated from the signal coil 16 in synchronism with engine speed is supplied to the gate of the thyristor 14 through the spark-timing control circuit 15, thereby causing the thyristor 14 to conduct. As a result, the electric charges stored in the capacitor 10 are discharged through the thyristor 14 and the primary winding of the ignition coil 11 to cause a high voltage to generate at the secondary winding of the ignition coil 11, thereby firing the spark plug 12.

The voltage across the gate and the cathode of the thyristor 14 which is indicated by $V_g$ at FIG. 4(*a*) is supplied to the comparator 18 to be compared to a set voltage $V_r$. When the voltage $V_g$ across the gate and the cathode achieves the set voltage $V_r$ or more, an output shown in FIG. 4(*b*) is obtained at the output of the comparator 18 to turn on the transistor 5. As a result, the transistor 4 is turned off to obtain the collector voltage in the form shown in FIG. 4(*c*), thereby substantially forcing oscillation to stop. In this manner, the output from the power circuit 1 is prevented from being supplied to the capacitor 10.

As stated earlier, the conventional ignition system detects the voltage across the gate and the cathode of the thyristor 14 before stopping oscillation. This arrangement creates a problem in that the magnetic energy which has been stored in the transformer 3 is discharged to the thyristor 14 just before oscillation stoppage, and the thyristor 14 is kept conducting for a long period to shorten the subsequent oscillation charging period, causing the capacitor 10 to be charged in an incomplete manner.

The effect which is given by the continuous conduction of the thyristor 14 for such long period grows great in particular at high engine speed because the cycle from one spark from the following spark is shortened. This creates another problem in that the thyristor 14 could be ultimately kept conducting until the following spark-timing, causing misfire.

In addition, because oscillation starts immediately when the voltage across the gate and the cathode of the thyristor 14 lowers, a voltage could be applied to the thyristor 14 by the power circuit 1 before the withstand voltage of the thyristor 14 has fully revived. This means that there is a possibility that the thyristor 14 is conducted again to short-circuit the output of the power circuit 1, creating another problem in that the capacitor 10 is charged in an incomplete manner.

SUMMARY OF THE INVENTION

It is an object of the present invention to dissolve these problems and to provide an ignition system for internal combustion engines, capable of obtaining a high capacitor charging voltage in a stable manner even if the engine is rotated at high speed.

The foregoing and other objects of the present invention have been attained by an ignition system for internal combustion engines comprising an ignition coil; a power circuit including a converter for converting the output of a battery into a high voltage; a capacitor arranged at the primary side of the ignition coil and charged by the output from the power circuit; a discharging control thyristor which conducts at a spark-timing of an internal combustion engine to discharge electric charges in the capacitor into the primary winding of the ignition coil, and converter control means which makes the converter inactive earlier than the input of a trigger signal to the gate of the thyristor by a first predetermined time, and which makes the converter active again in a second predetermined time since the thyristor has been triggered to conduct.

In accordance with the present invention, oscillation ceases earlier than the triggering of the discharge control thyristor by the first predetermined time. The oscillation restarts in the second predetermined time since the thyristor has been triggered to conduct.

The present invention can provide the ignition system which is capable of obtaining a stable and high capacitor charging voltage to ensure a spark for operating an engine even if the engine is rotating at a high speed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
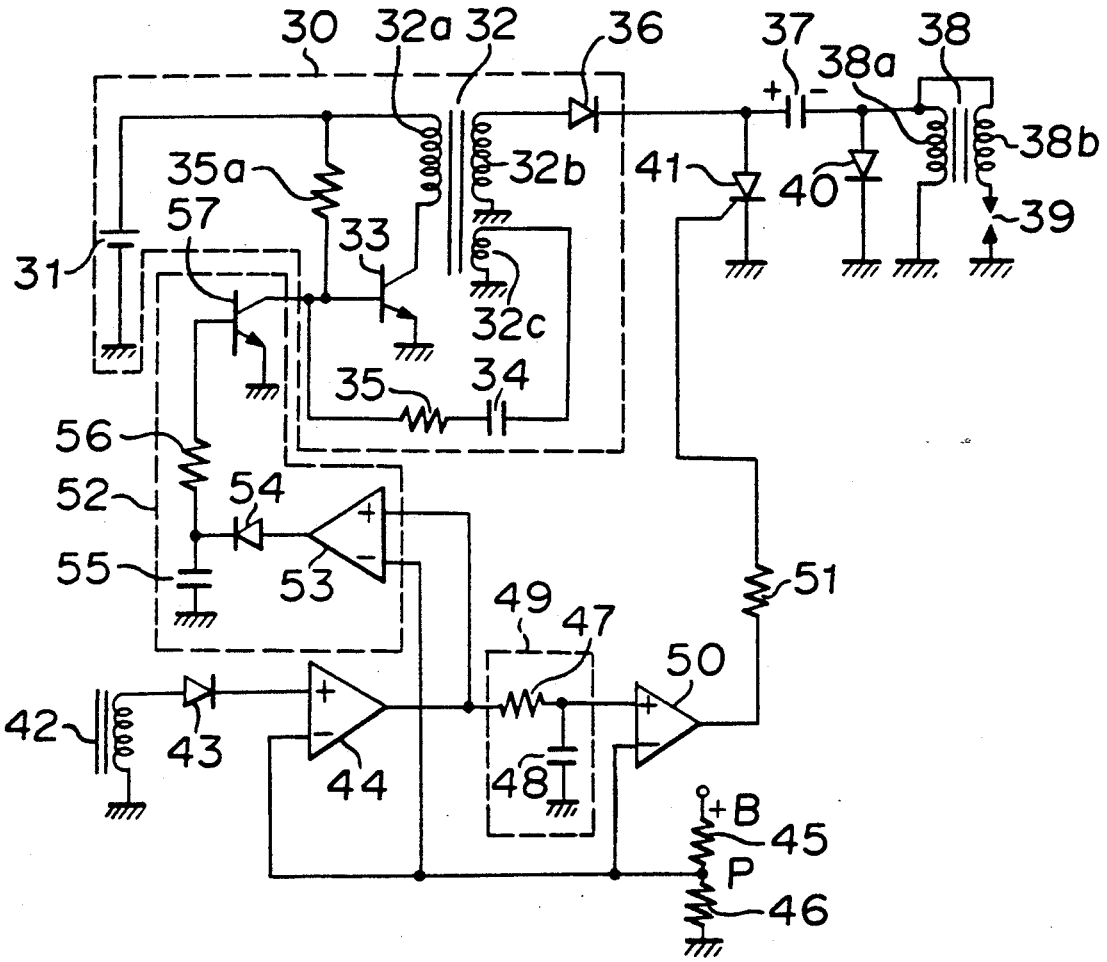
FIG. 1 is a schematic circuit diagram showing an embodiment of the ignition system according to the present invention.

Referring now to the drawings, and more particularly to FIG. 1 thereof, there is shown a schematic circuit diagram showing an embodiment of the ignition system according to the present invention. In FIG. 1, reference numeral 30 designates a power circuit which includes a converter, which will be explained below. The power circuit is constituted by a battery 31 and the converter. The converter comprises a transformer 32, an oscillation transistor 33, a capacitor 34, resistors 35 and 35*a*, and a rectifier diode 36. The battery 31 is grounded through the primary winding 32*a* of the transformer 32 and the collector to emitter connection of the transistor 33, and is also connected to the base of the transistor 33 through the resistor 35*a*. The transformer 32 has a feedback coil 32*c* which is connected to the base of the transistor 33 through the capacitor 34 and the resistor 35. The transformer 32 has the secondary winding 32*b* grounded through the diode 36, a capacitor 37 and the primary winding 38*a* of an ignition coil 38. The ignition coil 38 has the secondary winding 38*b* connected to a spark plug 39. The ignition coil 38 has the primary winding 38*a* connected in parallel with a diode 40. Between the junction of the diode 36 and the capacitor 37, and the ground is connected a discharge control thyristor 41.

Reference numeral 42 designates a signal coil which generates a signal in synchronism with the revolution of an engine (not shown). The signal coil is connected to a noninverted terminal of a comparator 44 through a diode 43. The comparator 44 has an inverted terminal connected to the junction P of resistors 45 and 46 which give a reference voltage. The comparator 44 has an output terminal connected to a noninverted terminal of a comparator 50 through a delay circuit 49 which comprises a resistor 47 and a capacitor 48 to have a predetermined delay time $t_1$. The delay time $t_1$ is set to be enough to decrease the electromagnetic energy of the transformer 32 in a suitable manner. The comparator 50 has an inverted terminal connected to the junction P, and an output terminal connected to the gate of the thyristor 41 through a resistor 51.

Reference numeral 52 designates an oscillation stoppage control circuit which comprises a comparator 53, a diode 54, a capacitor 55, a resistor 56 and an oscillation stoppage transistor 57. The comparator 53 has a noninverted terminal connected to the output terminal of the comparator 44. The comparator 53 has an inverted terminal connected to the junction P. The comparator 53 has an output terminal grounded through the diode 54 and the capacitor 55, and also connected to the base of the transistor 57 through the resistor 56. The transistor 57 has the emitter grounded, and the collector connected to the base of the transistor 33 of the power circuit. The capacitor 55 and the resistor 56 constitute a time constant circuit which has a predetermined delay time $t_2$. The delay time $t_2$ is set to be enough to be capable of restoring the withstand voltage of the thyristor 41 in a suitable manner. The delay circuit 49 and the oscillation stoppage control circuit 52 constitute a converter control unit.

Figure 2:
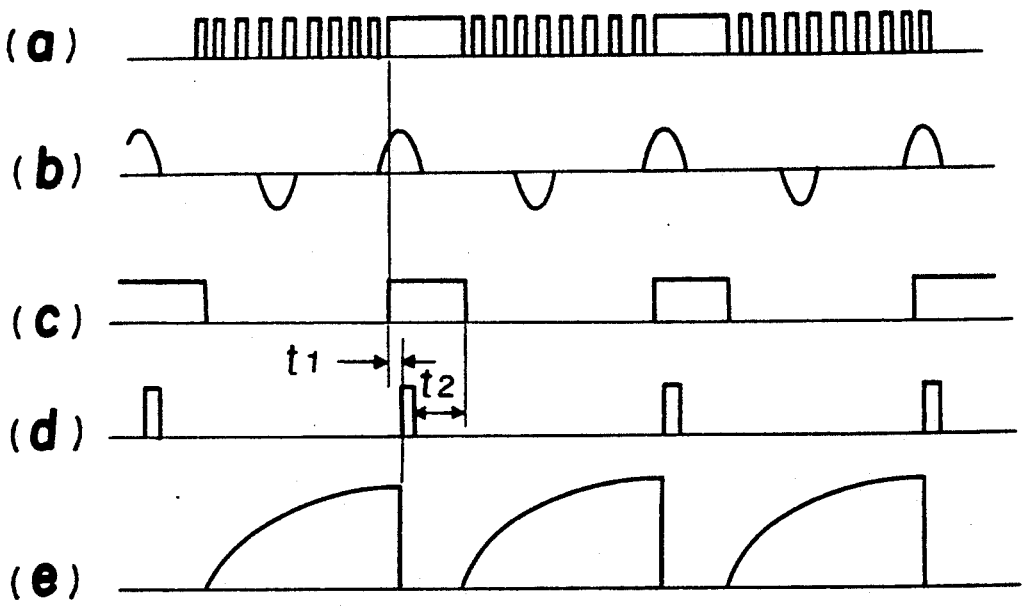
FIG. 2*a–e* are drawings of waveforms to help explain the operation of the system of FIG. 1.
Figure 3:
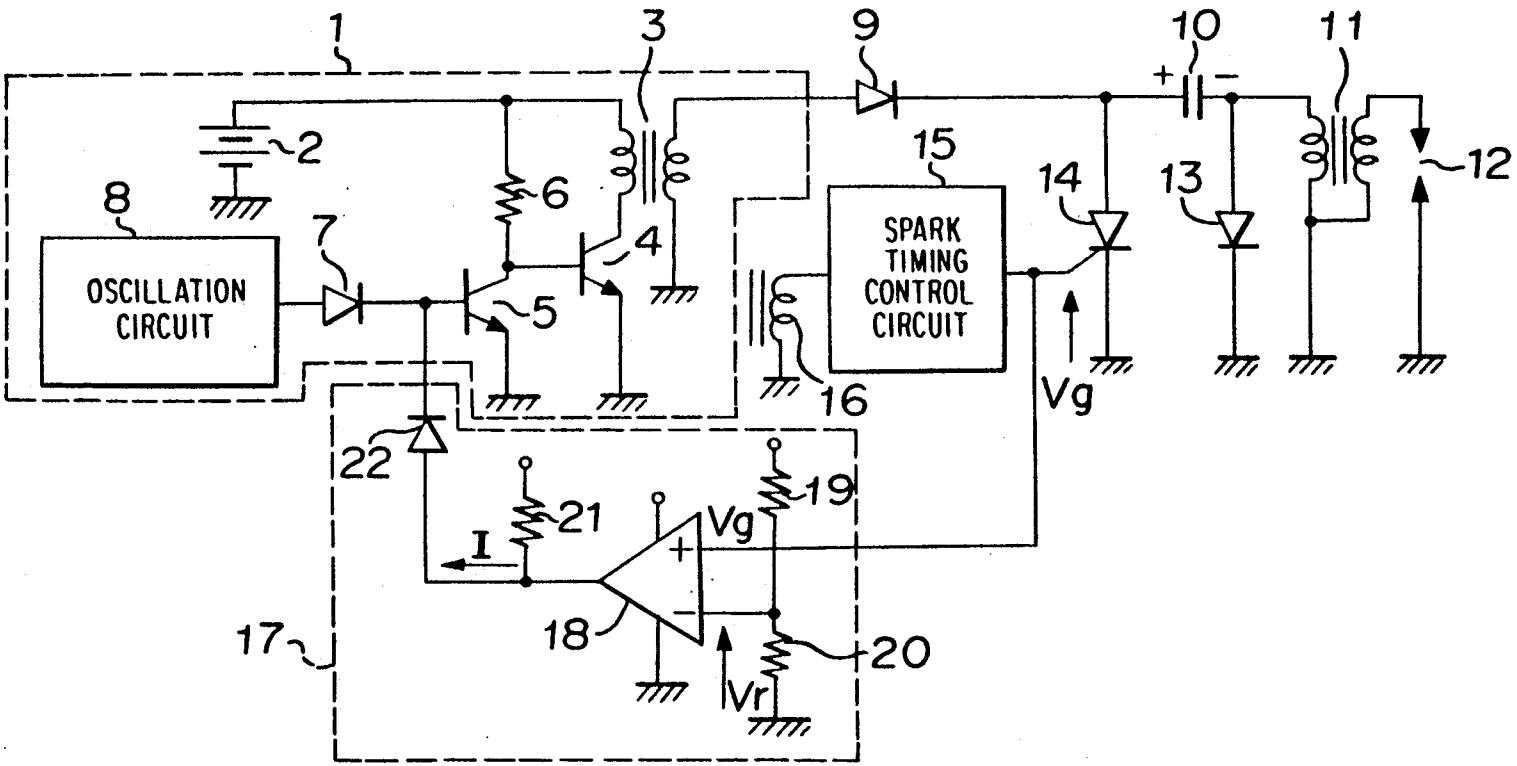
FIGURE 3 PRIOR ART
FIG. 3 is a schematic circuit diagram showing a conventional ignition system for internal combustion engines.
Figure 4:
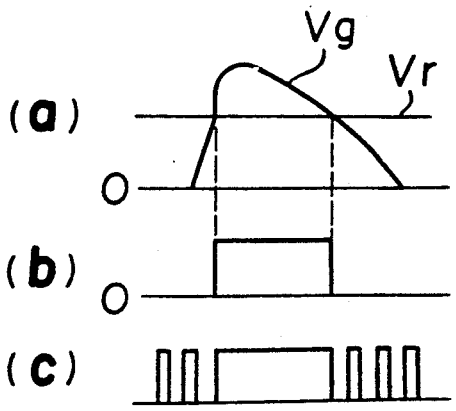
FIGURE 4 PRIOR ART
FIG. 4*a–c* are drawings of waveforms to help explain the operation of the conventional ignition system of FIG. 3.

Now, the operation of the embodiment shown in FIG. 1 will be described in detail in reference to FIG. 2. In FIG. 2, there is shown the collector voltage of the transistor 33 at FIG. 2(*a*). There is shown the output voltage of the signal coil 42 at FIG. 2(*b*). There is shown the voltage across the base and the emitter of the transistor 57 at FIG. 2(*c*). There is shown the gate voltage of the thyristor 41 at FIG. 2(*d*). There is shown the charge voltage for the capacitor 37 at FIG. 2(*e*).

When the output voltage from the signal coil 42 is 0 or negative, the output voltage form the comparators 44 and 53 is 0 because the output voltage from the signal coil 42 is lower than the reference voltage at the junction P. As a result, the transistor 57 is off, and the transistor 33 makes self-excited oscillation to repeat on and off as shown at FIG. 2(*a*), causing the converter to be active. Thus, the output voltage from the battery 31 is increased to a high level by the transformer 32, and the increased voltage is rectified by the diode 36, gradually charging the capacitor 37 as shown at FIG. 2(*e*).

When the output voltage from the signal coil 42 becomes positive and higher than the reference voltage, output voltages appear at the output terminals of the comparators 44 and 53. The output voltage of the comparator 53 is given to the base of the transistor 57 to generate a voltage across the base and the emitter of the transistor 57 as shown at FIG. 2(*c*), turning on the transistor 57. As a result, the transistor 33 is turned off to cease its oscillation, causing the converter to be inactive. At that time, the collector voltage of the transistor 33 maintains a high level as shown at FIG. 2(*a*).

On the other hand, the delay circuit 49 delays the output voltage of the comparator 44 by the predetermined delay time $t_1$, and transmits the output voltage to the comparator 50. Then the comparator 50 supplies the gate of the thyristor 41 with a gate voltage as shown at FIG. 2(*d*). Thus, the thyristor 41 is conducted to discharge the electric charges stored in the capacitor 37 through the thyristor and the primary winding 38*a* of the ignition coil 38. This results in the generation of a high voltage at the secondary winding 38*b* of the ignition coil 38, causing the spark plug 39 to produce a spark.

Next, when the output voltage of the signal coil 42 becomes lower than the reference voltage, the output voltages of the comparators 44 and 53 are 0. The electric charges which have been stored in the capacitor 55 are discharged through the base to emitter collection of the transistor 57, and the voltage across the base and the emitter of the transistor 57 becomes 0 after the predetermined delay time $t_2$ as shown at FIG. 2(*d*), turning off the transistor 57. As a result, the transistor 33 is turned on to restart its oscillation, causing the converter to be active again. The operation as stated earlier will be repeated.

In the embodiment, the oscillation ceases and makes the converter inactive earlier than the conduction of the thyristor by the certain time. This arrangement prevents a current from flowing through the transformer 32 in that time, and the electromagnetic energy stored in the transformer can be extinguished in that time. No trouble will occur even if the thyristor 41 is triggered after that time. In addition, the embodiments has such an arrangement in that the oscillation is stopped for the certain time after ignition to ensure the full revival of the withstand voltage of the thyristor 41 before the oscillation restarts. This arrangement prevents the thyristor 41 from continuously conducting.

Obviously, numerous modifications and variations of the present invention are possible in light of the above teachings. It is therefore to be understood that within the scope of the appended claims, the invention may be practiced otherwise than as specifically described herein.

What is claimed is:

1. An ignition system for internal combustion engines comprising:

an ignition coil (38);

a power circuit (30) including a converter for converting the output of a battery (31) into a high voltage;

a capacitor (37) arranged at the primary side of the ignition coil (38) and charged by the output from the power circuit (30);

a discharging control thyristor (41) which conducts at a spark-timing of an internal combustion engine to discharge electric charges in the capacitor (37) into the primary winding (38*a*) of the ignition coil (38); and converter control means (49, 52) which makes the converter inactive earlier than the input of a trigger signal to the gate of the thyristor (41) by a first predetermined time ($t_1$), and which makes the converter active again in a second predetermined time ($t_2$) since the thyristor (41) has been triggered to conduct.

2. An ignition system according to claim 1, wherein the converter includes a transformer (32) which has a feedback coil (32*c*).

3. An ignition system according to claim 2, wherein the converter includes an oscillation transistor (33), and the oscillation transistor has the base connected to the feedback coil (32*c*).

4. An ignition system according to claim 3, wherein the converter control means includes a delay circuit (49) which has the first predetermined delay time ($t_1$).

5. An ignition system according to claim 4, wherein the converter control means includes an oscillation stoppage circuit (52) which has the second predetermined delay time ($t_2$).

6. An ignition system according to claim 5, wherein the oscillation stoppage circuit (52) has an output transmitted to the base of the transistor (33).

7. An ignition system according to claim 4, further including a signal coil (42) whose signal is transmitted to the gate of the thyristor (41) through the delay circuit (49).

8. An ignition system according to claim 5, further including a signal coil (42) whose signal is transmitted to the oscillation stoppage circuit (52).

* * * * *